United States Patent [19]

Hukill

[11] 4,325,332

[45] Apr. 20, 1982

[54] AIR INJECTION SYSTEM FOR INTERNAL COMBUSTION ENGINES

[76] Inventor: Charles A. Hukill, 808 Kewanna Ave., Pittsburgh, Pa. 15234

[21] Appl. No.: 106,420

[22] Filed: Dec. 21, 1979

[51] Int. Cl.[3] ..... F02P 13/00; H01T 13/02

[52] U.S. Cl. ..... 123/169 PA; 123/169 C; 313/120

[58] Field of Search ..... 123/169 C, 169 PA, 169 PH, 123/41.31, 41.32; 313/120, 143

[56] References Cited

U.S. PATENT DOCUMENTS

| | | | |
|---|---|---|---|
| 1,166,385 | 12/1915 | Peck . | |
| 1,286,244 | 12/1918 | Danielson . | |
| 1,360,561 | 11/1920 | Mueller | 313/120 |
| 1,661,405 | 3/1928 | Broluska | 123/169 C |
| 2,034,855 | 3/1936 | Alby | 123/169 PA |
| 2,658,934 | 11/1953 | Field | 313/120 |

FOREIGN PATENT DOCUMENTS

| | | | |
|---|---|---|---|
| 2359237 | 6/1975 | Fed. Rep. of Germany . | |
| 2758055 | 6/1979 | Fed. Rep. of Germany | 123/169 C |
| 152270 | 10/1920 | United Kingdom | 313/120 |
| 723726 | 2/1955 | United Kingdom | 123/169 C |

*Primary Examiner*—P. S. Lall

*Attorney, Agent, or Firm*—Steele, Gould & Fried

[57] ABSTRACT

An air injection system, in a spark plug, whereby air is injected into the combustion cylinder comprising a compression chamber disposed in the body of the spark plug, a tube extending coaxially through the center of the plug having an air inlet means and communicating with both the cylinder and the compression chamber, an air inlet means disposed in the body of the plug which meters air into the tube and cylinder, and a valve means which controls the air inlet means and reduces backpressure on the valve during compression and subsequent expansion of gases in the firing cycle.

11 Claims, 5 Drawing Figures

AIR INJECTION SYSTEM FOR INTERNAL COMBUSTION ENGINES

BACKGROUND OF THE INVENTION

1. Field of the Invention

This invention relates in general to the field of spark plugs for internal combustion engines, and in particular, to a method of injecting air into the combustion cylinder in order to effect a more efficient operation of the engine.

2. Prior Art

In the operation of internal combustion engines, one significant problem is the inability to effect a complete burning of the air-fuel mixture delivered by the carburetor or other types of fuel injection systems to the combustion cylinder. It is known that when a vacuum-balancing quantity of any combustion promoting vapor, such as oxygen or air, is introduced into the combustion chamber prior to the ignition of the air-fuel mixture, a reduction or complete elimination of the need for the piston to act against the progressive vacuum in the cylinder results. This lessening of the amount of energy expended by the piston as a result of the vapor injection has at least two positive advantages. Firstly, there is an increase in gas mileage since effective horsepower is increased. Secondly, a more complete combustion of the air-fuel mixture results and the emission of what is commonly called smoke or soot (i.e. unburned hydrocarbons) during the final upstroke of the engine is decreased, producing a cleaner less polluting exhaust. Other advantages can also arise if the engine is known to burn oil or is required to run on a high octane fuel. In the former case the oil deposits in the engine will be significantly lessened whereas in the latter a lower grade of fuel may be substituted.

The problem heretofore with injecting a metered amount of combustion promoting vapor, such as external air, into the combustion chamber during compression is that regardless of the type of injecting device used, the backpressure on the air inlet mechanism produced during the first upstroke of the engine is so great that there is a tendency for the mechanism to eventually break down and release excessive amounts of air or air-fuel mixture. It is known, in the prior art, that by providing an auxiliary chamber into which a part of the compression pressure may be permitted to escape, the backpressure on the air-inlet means of the injector is significantly reduced. However, because the compression pressures are so great, as much as six to eight times the volume of the air-fuel mixture, this provision has not satisfactorily addressed the problem. It is also known in the prior art, that an air inlet means that is responsive to the high pressures and high temperatures produced during compression, such as a ball valve mechanism, results in a lessening of backpressure. This method of injection has also proved unsatisfactory since the compression pressures and temperatures are so great.

Thus, although the prior art appears to have been cognizant of some of the problems associated with air-injection systems, no device heretofore has satisfactorily solved the problem of reducing backpressure in the system to the extent that this invention does.

In a distinct departure from the prior art, this invention teaches that by uniquely positioning an auxiliary pressure reducing chamber in association with an enclosed valve chamber housing a pressure absorbing valve inlet and outlet means, backpressure in the air-injecting device may be significantly reduced resulting in an increase in the useful life of the device and a consequent increase in the efficiency of operation.

This invention also teaches that by strategically locating an air inlet and outlet tube in a spark plug wherein such tube is also part of the positive electrode, both the positive and negative electrodes may be effectively cleaned and cooled as a result of the air-injection process and consequently be rendered more effective conductors of ignition spark. Although other air-injection systems might similarly provide a cooling and cleaning means for the electrodes of a spark plug, it is the unique internal configuration taught by this invention which makes such a process most effective.

SUMMARY OF THE INVENTION

It is an object of this invention to provide an improved method for injecting air into the combustion cylinder during compression.

It is another object of this invention to provide an air-injection system that effectively reduces compression backpressure within the injecting device.

It is a further object of this invention to provide an air-injection system that reduces the amount of energy necessarily expended by the piston within the combustion cylinder so as to result in better gas mileage.

It is yet a further object of this invention to provide an air-injection system which will promote a more complete combustion of the air-fuel mixture within the combustion cylinder resulting in a cleaner-burning less polluting engine operation.

It is yet another object of this invention to provide an air-injection system in a spark plug which is easily, conveniently, and inexpensively adapted to any internal combustion engine.

It is another object of this invention to provide an air-injection system which will last significantly longer than any other system heretofore and consequently result in a more efficiently operating engine.

It is yet another object of this invention to provide an air-injection system which will be self-cleaning and self-cooling.

It is still a further object of this invention to provide an air-injection system which will also serve as a means by which the spark plug electrodes may be cooled and consequently rendered more effective in their ability to conduct a fatter, hotter, more viable spark.

It is yet a further object of this invention to store a portion of the products of combustion, such products being hot gases, under pressure in an auxiliary pressure reducing chamber and subsequently release the hot gases back into the compression chamber of the cylinder, thus raising the temperature of the gases in the next compression cycle.

These and other objects of this invention are accomplished by providing an air-injection system in a spark plug comprising a compression chamber with a tube extending through its center that extends to the combustion cylinder and additionally to a valve air inlet-outlet means which comprises an enclosed valve chamber housing a uniquely configured valve disk which controls the amount of air taken into the plug through the spark plug air inlet mechanism.

This air-injection system provides a uniquely effective, novel, convenient, lasting, and inexpensive method of increasing the efficiency of the operation of the internal combustion engine.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE DRAWINGS

Figure 1:
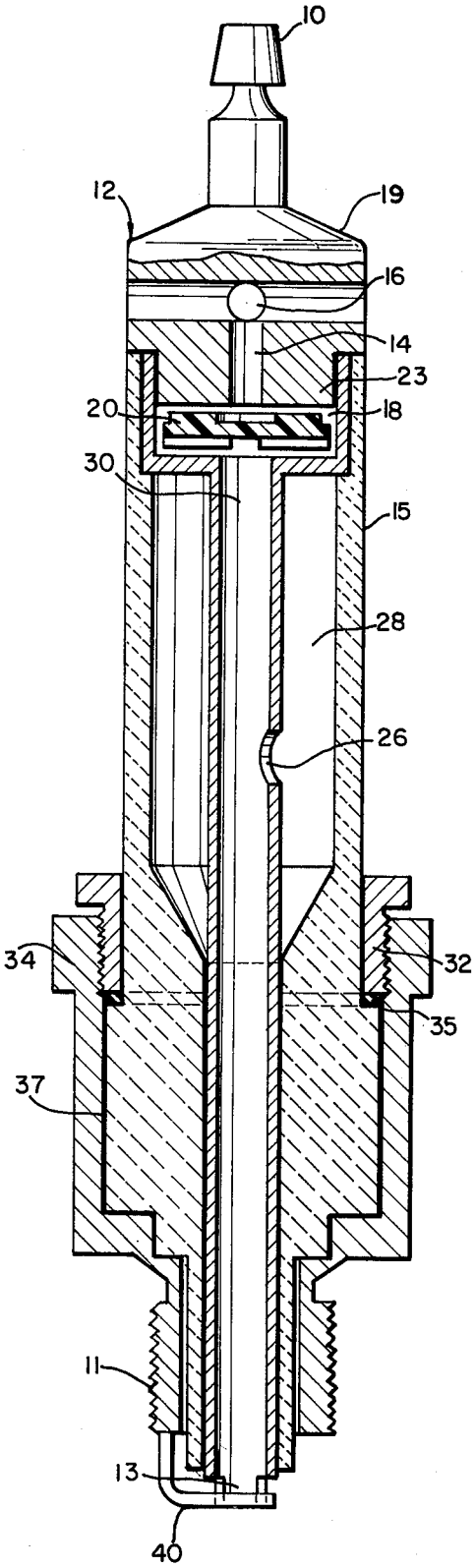
FIG. 1 is a cross-sectional view of an air injection system, in a spark plug, accordng to this invention.
Figure 2:
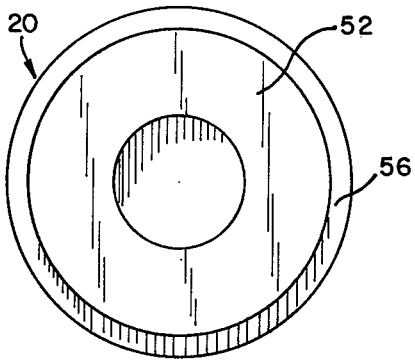
FIG. 2 is a top view of the valve disk which is contained in the enclosed valve chamber, inside the spark plug.
Figure 3:
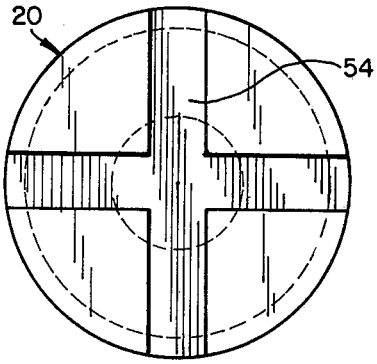
FIG. 3 is a bottom view of the valve disk which is contained in the enclosed valve chamber.

The present invention is directed to an air injection system for internal combustion engines preferably embodied in a spark plug. This system is illustrated in FIGS. 1, 2 and 3. The spark plug 12 which embodies this system is shown in FIG. 1. The upper body 15 of the plug is presently composed of porcelain, however, a future embodiment of the plug may be composed of another suitable insulating material. The plug is inserted into the cylinder block and is held in position by a threaded body portion 11. A spark plug wire is connected to a brass nub 10 that is screwed on to cap member 19 of the plug. In conventional four-cycle operation, during the first downstroke of the engine, that is the first suction cycle, air is drawn into the plug through air inlet means 16 in cap member 19 and proceeds to travel through intake passage 14 and into the enclosed valve chamber 18, defined by annular section 21 of tube 30 and the lower portion 23 of cap member 19. The external air flows around the valve disk 20, preferably made of a heat and wear resistant material, such as Teflon or the like, and is then drawn into the tube 30, which is preferably composed of a nichrome substance which extends through the body of the plug. After allowing a metered quantity of air to enter the tube, the valve disk 20 contacts the tube and effectively reduces the external air supply. The air that has entered the tube is finally deposited into the combustion cylinder through tube outlet 13. The result of this additional supply of air is that a more complete burning of the air-fuel mixture is effected during ignition resulting in greater gas mileage and a reduction of pollutants emitted into the atmosphere.

During compression, a mixture of hot gases and air are spewed back into the tube 30 from the combustion cylinder. The mixture travels up the tube and is deposited into the compression chamber 28 by way of aperture 26. The compression chamber acts to significantly relieve the tremendous pressure on the valve means during this first upstroke (compression) of the engine as well as during the even more destructive subsequent firing cycle. After ignition and the second upstroke of the engine, the cycle is repeated, however, this time the external supply of air not only acts to increase gas mileage and reduce pollutants but acts as a means of cleaning the compression chamber and cooling the tube and spark plug electrodes.

When the external air supply enters the enclosed valve chamber 18 during suction, it effectively flows around the valve disk 20 until the disk is drawn into contact with the tube 30. With reference to FIG. 2, which is a top view of the valve disk 20, the upper half of the disk comprises an annular projection 52 which is somewhat recessed from the periphery of the disk 56. This upper configuration of the disk 20 acts to lessen resistence in the chamber during the suction and expansion cycles of the engine.

FIG. 3 shows the valve disk 20 as it appears from its underside. The lower half of the disk has mutually perpendicular radial grooves 54 which allow air that enters the enclosed valve chamber 18 to pass into the tube 30. Both the annular projection 52 and the radial grooves 54 have a preferably rectangular cross section.

Referring again to FIG. 1, the lower portion of the plug 34 is sealed to the inner portion 37 by way of a copper gasket 35, and retained by ring 32, which threadably engages the lower portion 34. The negative electrode 40 is connected to the lower portion of the plug 34, and is interposed into the extended portion of the inner tube 13 to form a unique four point gap configuration.

Figure 4:
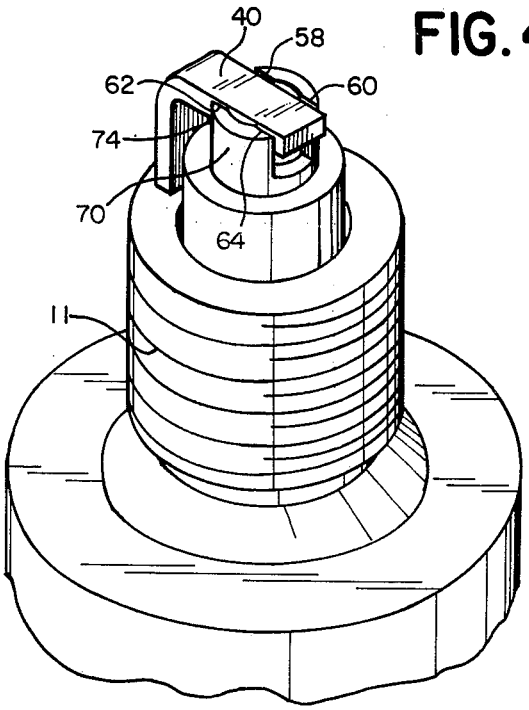
FIG. 4 is a perspective view of the electrode gap configuration.

FIG. 4 shows the four point gap configuration. The extended end 70 of the inner tube 30 preferably has two longitudinal slots 72 and 74, which allow the base portion 42 of the negative electrode 40 to be interposed therethrough, parallel to the four tube surfaces 58, 60, 62 and 64. These surfaces, when properly positioned in relation to the negative electrode, serve as spark conductors and because of this multiple configuration the probability of a spark at the proper time in the ignition cycle is improved. Additionally, because the air is injected from directly above the base portion of negative electrode 40, passing through substantially semi-circular spaces which form outlet 13, the process of air injection into the combustion cylinder serves as a cooling and cleaning means for the electrode resulting in a more viable spark. Further, a spark that does occur at any of the four points 58, 60, 62 or 64 will be fatter and hotter since it will be occuring in a less-gaseous atmosphere.

Figure 5:
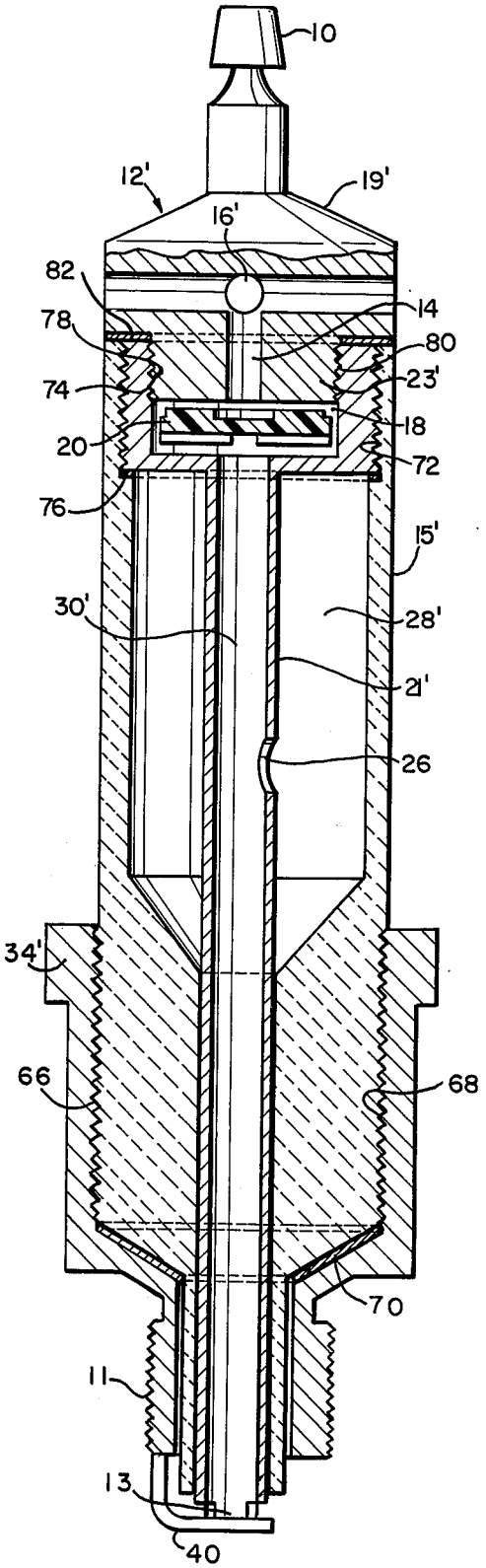
FIG. 5 is a cross-sectional view of an alternative embodiment of an air injection system, in a spark plug, according to this invention.

An alternative embodiment 12' of the present invention is shown in FIG. 5, wherein analogous members are designated by identical numerals with superscript primes. In the embodiment of FIG. 5, the upper body 15' is provided with a threaded portion 66 which engages a threaded portion 68 on lower portion 34'. The connection is sealed by gasket 70, which may be a thin copper gasket. In view of the larger diameter of the upper portion of upper body 15', the combustion chamber 28' is larger than in the embodiment of FIG. 1, due to the larger outer diameter of upper body 15'. The inner portion of the uppermost part of upper body 15' is provided with a threaded section 72, which engages threaded portion 74 on the outer surface of annular section 21 of tube 30. The upper portion of chamber 28' is sealed by gasket or washer means 76. The inner surface of annular section 21 is provided with a threaded section 78 which engages threaded portion 80 on the outer surface of lower portion 23' of cap member 19'. A gasket or washer means 82 is utilized to seal the connection between the cap member 19' and annular section 21' of tube 30'. In view of cap member 19' being somewhat larger than cap number 19, radial bore 16' must be longer as well. The operation of the air injection system embodied in the spark plug 12' shown in FIG. 5 is identical to the operation of the spark plug described in connection with FIG. 1, in all respects, except that the capacity of compression chamber 28' has been significantly increased. Of course, the directly threaded connecting means utilized in the embodiment shown in FIG. 5 may also be utilized in connection with the embodiment shown in FIG. 1 wherein such features have been omitted where possible for purposes of clarity.

The present invention may be embodied in other specific forms without departing from the spirit or essential attributes thereof, and accordingly, reference should be made to the appended claims rather than to the foregoing specifiction as determining the scope of this invention.

I claim:

1. An air injection system for a spark plug and the like, for injecting air into a combustion cylinder prior to compression, comprising:

air inlet means disposed in said plug, said inlet means including a valve means for metering air into said cylinder;

a tube connected to said valve means and extending therefrom through said plug, being in communication with said cylinder when said plug is mounted in an engine; and, a compression chamber surrounding the tube, substantially occupying the interior of the plug, and in communication only with the tube, gases from prior combustions filling said chamber during exhaust strokes, whereby air and gases from prior combustions are injected into the cylinder prior to ignition, and back pressure shock on the valve means is substantially reduced.

2. An air injection system as described in claim 1 wherein said compression chamber is symetrically disposed in said plug and said tube is coaxially disposed through said chamber.

3. An air injection system as described in claim 1, wherein said tube has at least one aperture for communicating with said compression chamber.

4. An air injection system as described in claim 1, wherein said air inlet means comprises at least one radial bore communicating with the valve means.

5. An air injection system as described in claim 1, wherein said valve means comprises:

an enclosed valve chamber, communicating with said air inlet means and said tube; and, a valve disk disposed in said chamber.

6. An air injection system as described in claim 5, wherein said disk comprises upper and lower halves, the upper half having an annular projection which is recessed from the periphery of the disk, and the lower half having mutually perpendicular radial grooves.

7. An air injection system as described in claim 6, wherein there are four of said mutually perpendicular radial grooves.

8. An air injection system as described in claim 6, wherein said annular ring and said radial grooves have rectangular cross-sections.

9. An air injection system as described in claim 5, wherein said valve disk is composed of a heat and wear resistant material.

10. An air injection system as described in claim 1, wherein said spark plug has at least one positive electrode, said tube forming a part of the electrode, and at least one negative electrode.

11. An air injection system as described in claim 10, wherein said tube has at least two longitudinal slots into which said negative electrode may be interposed providing a four point spark gap configuration.

* * * * *